United States Patent [19]

Garber

[11] 4,027,772

[45] June 7, 1977

[54] PROTECTIVE CIRCUIT FOR OVERLOAD SENSOR

[75] Inventor: Eugene L. Garber, McConnellsburg, Pa.

[73] Assignee: Fulton Industries, Inc., McConnellsburg, Pa.

[22] Filed: Apr. 17, 1975

[21] Appl. No.: 568,932

[52] U.S. Cl. ..... 214/762; 212/39 MS; 340/267 C; 361/1

[51] Int. Cl.[2] ..... E02F 3/84

[58] Field of Search ..... 214/762; 212/39 R, 39 A, 212/39 MS; 340/267 C; 317/9 R, 9 D, 9 C

[56] References Cited

UNITED STATES PATENTS

| | | | |
|---|---|---|---|
| 2,993,148 | 7/1961 | Pywell | 317/9 D |
| 3,058,034 | 10/1962 | Sandin | 317/9 R |
| 3,072,264 | 1/1963 | Sennebogen | 212/39 MS |
| 3,199,685 | 8/1965 | Bopp | 340/267 C |
| 3,612,294 | 10/1971 | Wilkinson | 212/39 MS |

*Primary Examiner*—L. J. Paperner

*Assistant Examiner*—Ross Weaver

*Attorney, Agent, or Firm*—Irvin A. Lavine

[57] ABSTRACT

A protective circuit for an overload sensor of a lifting boom, such as an aerial platform boom. Excess deflection of the boom under load, due to such factors as weight of the load, boom angle and boom extension, is detected by the actuation of an overload sensor switch engaged by the free end of a beam which extends generally parallel to the boom, the other end of the beam being fixed to the boom. The overload sensor switch is in a protective circuit which causes interruption of current to controls which effect movement of the boom in a manner to increase the boom deflection, and which circuit causes the interrupted circuit to remain interrupted independently of the position of the overload sensor switch. The circuit requires positive resetting once there has been such interruption. The protective circuit includes a drop out relay in series with the overload sensor switch, a latching relay with re-set coil, and control circuit switches controlled by the latching relay.

15 Claims, 5 Drawing Figures

PROTECTIVE CIRCUIT FOR OVERLOAD SENSOR

BACKGROUND OF THE INVENTION

The present invention relates to protective circuits for use with a boom, such as a crane or aerial platform apparatus boom, provided with a boom-deflection or overload sensing device.

Cranes of the boom type have long been known, these cranes being provided with a boom which is capable of being raised and lowered about a horizontal axis, and swung about a vertical axis. Such booms may also be telescopic, and such booms are also used in connection with aerial platform apparatus, which latter have a workman's platform or basket, usually at the outer end of the boom. As is well known, the load on the boom, tending to cause it to deflect, increases with an increase in the weight carried, with a lowering of the boom from a near vertical position to a horizontal or near-horizontal position, and with telescopic extension of the boom. Each of these movements may be considered as a "forward" movement, whereas the opposite movements, such as reducing the weight, raising the boom and telescopically retracting the boom may be known as rearward movements, it being understood that the forward movements increase the stress on the boom and its components, whereas rearward movements decrease the stress on the boom and its components.

A number of devices have been suggested for detecting or sensing the stress in the boom, and consequently the approach of the loading of the boom to an overload condition. An overload condition is one in which the boom is at or closely approaching a failure condition. In addition, where the boom is a part of a mobile, vehicle-mounted crane or aerial platform apparatus, an overload condition may be deemed as a condition wherein tipping of the machine is being approached during a forward movement of the boom. One known device for sensing boom overload comprises a beam having one end fixed to the boom, and extending generally parallel to the boom, the beam having a free end remote from its fixed end. A micro-switch is provided at or adjacent the beam free end, and is mounted so that it is caused to be actuated to open position upon deflection of the boom beyond a predetermined amount. The micro-switch is, in turn, connected with circuitry which may include conductors in the control circuits of the boom controlling forward movement. Hence, an overload condition which will cause actuation of the micro-switch and thereby break the forward direction control circuits will prevent movement of the boom towards a more dangerous condition, but permit reverse movement, so that the position or condition of the boom may be changed towards a safer condition.

It has been found that with the overload sensor of the beam and switch type, certain problems have arisen in connection with actual operation. Specifically, as the boom is being moved in a forward direction, for example as it is being lowered towards the horizontal, the deflection of the boom which causes actuation of the micro-switch by the beam is not a steady progression, but instead there is some variation in the boom deflection. This is due to the necessary flexibility of the boom, which is believed to be the primary, if not the sole reason for the boom to oscillate so as to give rising and falling values of boom deflection, as the boom continues in the above mentioned forward direction.

This oscillation of the boom has been found to cause the micro-switch to open and close, as the boom passes into a transition zone intermediate between an overload condition zone and a non-overload condition zone. Since the overload sensor switch would thereby be caused to open and close, it would also cause the forward movement control switches to open and close, and there could be built up within the system an ever increasing oscillation of the boom, which would be deletorious. The boom could possibly be thereby caused to destroy itself, or damage itself, or, where there is a workman in a platform or basket, in the case of an aerial platform apparatus, the workman could be injured, as by being thrown from the platform or basket.

SUMMARY OF THE INVENTION

A boom is provided, preferably for an aerial platform apparatus which includes a workman's platform or basket, as at the outer end of the boom. The boom may be raised and lowered, and is telescopic. An overload sensor is provided on the boom, being a beam having a first end fixed to the boom, as to the side of the boom, and having its opposite end free: adjacent the free end of the beam is a switch, also secured to the boom. When the boom moves in a forward direction, as by being lowered, and/or by being telescopically extended, it deflects to such an extent that, near the overload condition, the overload sensor switch is actuated, specifically being opened. Electric control circuits are provided, for controlling the forward movement of the boom, and in these control circuits are switches. These switches are actuated by a latching relay coil, when energized. Energization is in response to the movement of a drop out relay that is held in a first condition in which no current is supplied to the latching relay coil while the overload sensor switch is not actuated. Upon actuation of the overload sensor switch, by boom deflection, the drop out relay is de-energized, permitting its contacts to move to a second position in which the latching relay coil is energized, the latching relay coil thereby causing the control circuit switches to move into position to prevent further forward movement of the boom. Once the latching relay coil has been energized, the control switches remain in the positions thereof which prevent forward boom movement, even though the overload sensor switch should return, momentarily, to the non-overload position thereof. A restoring circuit is provided which includes a manual reset switch, the restoring circuit including a reset coil for resetting the control circuit switches, the restoring circuit further including switches controlled by the drop out relay. Hence, there must be reverse, load-decreasing movement of the boom, to effect restoration of the overload sensor switch to its initial non-overload condition, and consequently the energization of the drop out relay so as to close the switch thereof in the restoring circuit. Only then will actuation of the reset switch permit energization of the reset coil and movement of the control circuit switches to the position to again permit forward movement of the boom.

Preferably, there is provided a boom having at its outer end a workman's platform mounted so that it may be rotated between positions in which the platform lies adjacent the two sides of the boom, the platform being of substantial length, so that when it is rotated into a position lying along one side of the boom, one end of the platform extends substantially beyond the end of the boom: movement to this beside-the-boom position is considered a forward movement, since it shifts the center of gravity and therefore the load in a manner to increase boom deflection. The control circuits which include a switch for preventing forward movement, thereby include the controls for platform rotation. Further, in a preferred embodiment, boom lifting and lowering is effected through operation of a current reversing switch which is manually controlled, and which is connected to a direct current torque motor servo hydraulic valve which is characterized by rotating in either direction, dependent upon the direction of the current flow to it, said motor effecting raising of the boom when rotating in one direction and lowering of the boom when rotating in the opposite direction. The circuitry includes a diode in one branch which, when the latching relay coil has been energized and has shifted the control circuit switch in the control circuit to the noted direct current torque motor, permits actuation of the motor only in direction to raise the boom, and thereby decrease the deflection of the boom.

Among the objects of the present invention are to provide a protective circuit for a boom with an overload sensing switch.

Another object of the present invention is the prevention of a protective circuit in combination with a boom and an overload sensing switch which will prevent oscillation of the boom and/or overload sensing switch.

Yet another object of the present invention is to provide a boom, an overload sensing switch, and an interrupter for the boom control forward movement of the circuits, and to cause the boom forward control circuit switch to remain in the actuated position thereof until dangerous or overload conditions have been removed.

Other objects and many of the attendant advantages of the present invention will be readily apparent from the following description and claims, and the appended drawings.

DESCRIPTION OF THE PREFERRED EMBODIMENT

Figures 1, 4:
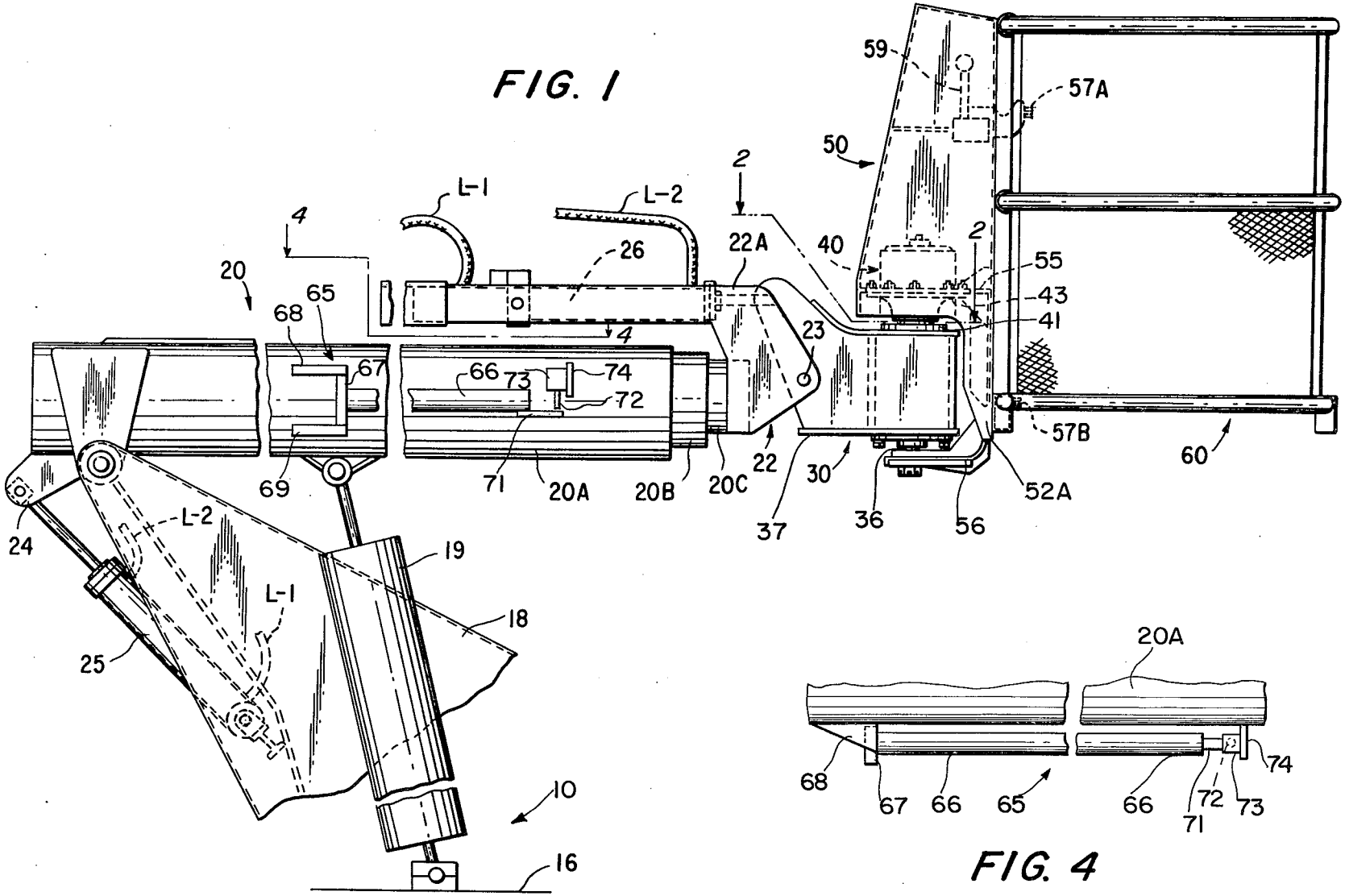
FIG. 1 is an elevational view, with parts broken away, of a portion of an aerial platform apparatus embodying the present invention.
FIG. 4 is a plan view taken on the line 4—4 of FIG. 1, with parts broken away.

Referring now to the drawings, wherein like or corresponding reference numerals are used for like or corresponding parts throughout the several views, there is shown in FIG. 1 an aerial lift platform apparatus generally designated 10, and including a boom 20, which is preferably mounted on a wheeled vehicle, not shown, which is engine powered and steerable. At its outer end, the boom 20 carries a workman-supporting platform 60; boom 20 may be telescopically extended and retracted, as by a hydraulic cylinder.

Base 16, which is rotatable about a vertical axis by a conventional mechanism, has extending upwardly from it a boom support 18, typically in the form of a pair of spaced apart, generally vertically extending plates having between them a boom luffing cylinder 19 which is operated by hydraulic fluid from a suitable pump through control valving to raise and lower the boom 20. At its upper rear end, the boom support 18 has pivotally connected to it about a horizontal pivot the telescopic boom 20 which may be of known configuration, having three telescopic sections 20A, 20B and 20C. Telescopic movement of the sections relative to each other is effected by suitable power means, such as one or more hydraulic cylinders, not shown, operated by a pump through control valves. A support generally designated 22 is secured to the end of the fly section 20C, and a horizontal pivot pin 23 pivotally connects a connector 30 to the support 22, and hence to the boom 20. The connector 30 carries a rotary hydraulic motor generally designated 40, to which is connected a platform support structure 50, which latter carries the platform 60.

In order to maintain the platform 60 level during luffing movement of the boom 20, the boom 20 is provided at its rear with an ear 24 to which is connected the piston rod of a master cylinder 25, having the cylinder itself pivotally connected to the boom support 18. The aforementioned support 22 has a portion thereof extending above the boom 20, to carry a slave cylinder 26. Hydraulic lines L-1 and L-2 interconnect the master cylinder 25 and the slave cylinder 26, so that as the boom luffing cylinder 19 raises the boom, the master cylinder 25 will be actuated, and will in turn actuate the slave cylinder 26, to impart simultaneous, equal and opposite rotational movement of the connector 30 about the pivot pin 23, relative to the rotational movement of the boom 20 about its pivotal connection with the boom support 18.

Figure 2:
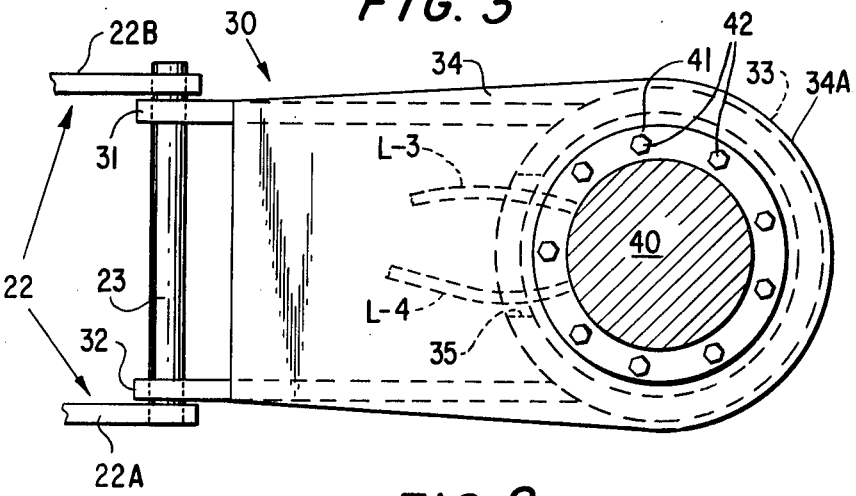
FIG. 2 is a cross-sectional view taken on the line 2—2 of FIG. 1.

As may be seen in FIGS. 1 and 2, the support 22 at the end of the fly section 20C is in the form of a pair of spaced plates 22A and 22B, parallel to each other, and lying in vertical planes. The pivot pin 23 passes through the plates 22A and 22B forming the support 23, and also through plates 31 and 32 forming parts of the connector 30. The plates 31 and 32 are in vertical planes, and lie inwardly of the plates 22A and 22B of the support 22. At the right hand or forward end, the connector 30 terminates in a housing 33 which has a vertical axis, and which is in the form of a cylinder, although a completely cylindrical housing is not required and is shown herein as being utilized for purposes of strength: a semi-cylindrical housing could be utilized. The plates 31 and 32 are joined to the housing 33, and a plate 34 lies along the top surfaces of the plates 31 and 32, plate 34 terminating in a semi-cylindrical formation, or flange 34A having a slightly greater radius than that of the housing 33. A flange 41 of platform rotating motor 40 overlies the plate 34, and bolts 42 secure the motor 40, through flange 41, to the plate 34, and hence to the connector 30. As will be seen, the diameter of the structure including the housing 33 and the flange 34A of plate 34 is at least as large as the width of the connector 30, as determined by the spacing of the plates 31 and 32, to thereby permit full 180° rotation of the platform 60, from one side of the boom and connector 30 to the other side thereof.

A platform support structure 50 is provided, which is generally in the form of a hollow, somewhat pyramidal housing including spaced side plates and a horizontal plate 55 which extends between them, and which is provided with an opening in which is positioned the rotary fluid motor 40. The motor 40 is provided with a second flange 43 which underlies the plate 55, and is secured to it by an annular series of bolts 44. The flange 43 is rotational relative to the flange 41, so that when fluid is supplied to the rotary motor 40, the upper part thereof, including the flange 43 will rotate about the axis of the motor 40, which is coincident with the axis of the housing 33, while the part of the motor 40 to which the flange 41 is connected remains stationary. Rotary motor 40 thereby provides power for rotating the platform 60. As shown in FIG. 2, the left hand portion of the housing 33 is provided with an opening 35 through which passes hydraulic lines L-3 and L-4 for supplying hydraulic fluid to the motor 40, which is of known construction.

The platform support 50 has a portion 52A extending downwardly to a point below the bottom of the connector 30. A bracket 56 extends rearwardly from the lower portion of the platform support 50, being journalled on a shaft 36 which is coaxial with the motor 40 and which is carried by a lower plate 37 of the connector 30.

The platform support 50 has the platform 60 secured thereto at connecting points 57A and 57B, which may take the form of bolts or the like. Mounted within the platform support structure 50, and accessible to workmen on the platform 60 are controls 59, for control of the platform and the boom, by the workman on the platform 60. Controls are also provided at ground level.

Figure 3:
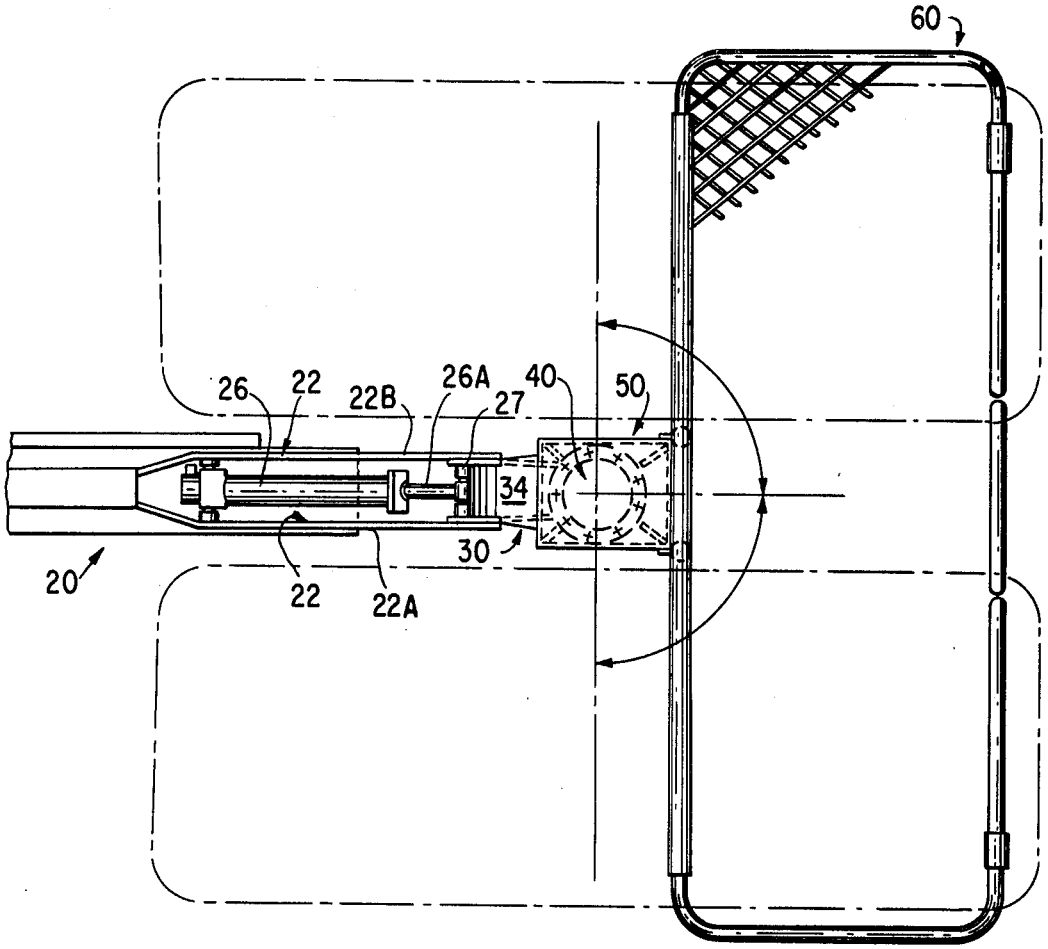
FIG. 3 is a plan view of the end portion of the boom and platform shown in FIG. 1.

As is clearly shown in FIG. 3, the platform 60 is of rectangular plan form, and in the central or neutral position shown in full lines in FIG. 3, the platform support 50 is connected to the mid-portion of a long side of the rectangular platform 60. Preferably, the length of the platform is about eight feet, so as to accommodate certain building materials which have a length of eight feet. As is further shown in FIG. 3, the platform 60 may be moved between two extreme positions relative to the boom 20, one position having a side of the platform adjacent the left side of the boom 20, and substantially parallel thereto, and the other position having the same side of the platform substantially adjacent the right side of the boom 20, and substantially parallel thereto. With the construction shown, slightly more than 180° of rotation in the horizontal plane, about the axis of the motor 40, may be accomplished. The axis of rotation of the platform 60 is external of the platform, being the axis of the rotary hydraulic motor 40, and shaft 36. When the platform 60 is rotated toward either of the two extreme positions, there may occur a movement of the center of gravity of the platform outwardly away from the boom support 18, as when a workman and/or materials and tools are located at one end of the platform.

Referring now to FIGS. 1 and 4, there is shown an overload sensor device 65 which includes a beam 66 that is connected at one end to the base section 20A of the boom 20, and which has its other end free. Thus, the beam 66 is secured at its left end to a plate 67, which extends generally perpendicularly to the axis of the boom 20. Plate 67 is, in turn, secured to a pair of spaced anchor plates 68 and 69, which are secured, as by welding, to the outside of the boom base section 20A, and preferably to the side thereof. At its right hand or forward end, the beam 66 has connected to it an engagement plate 71 for engaging the plunger 72 of a micro-switch 73. Micro-switch 73 is secured to a switch support plate 74, which is connected to the side of base section 20A. Consequently, when the boom 20 is loaded, it will deflect, and its axis will be generally arcuate. This will effect movement of the overload sensor switch 73 relative to the engagement plate 71 of beam 66, and, upon a predetermined amount of boom deflection, resulting from a predetermined load, approaching an overload, the micro-switch 73 will be actuated. The overload or near-overload condition will result from a number of factors, acting either alone or in combination. These factors include the angle of elevation of boom 20, the amount of extension or outward telescoping of boom 20, and the rotative position of platform 60, whereby the center of gravity of the platform may be carried outwardly.

Figure 5:
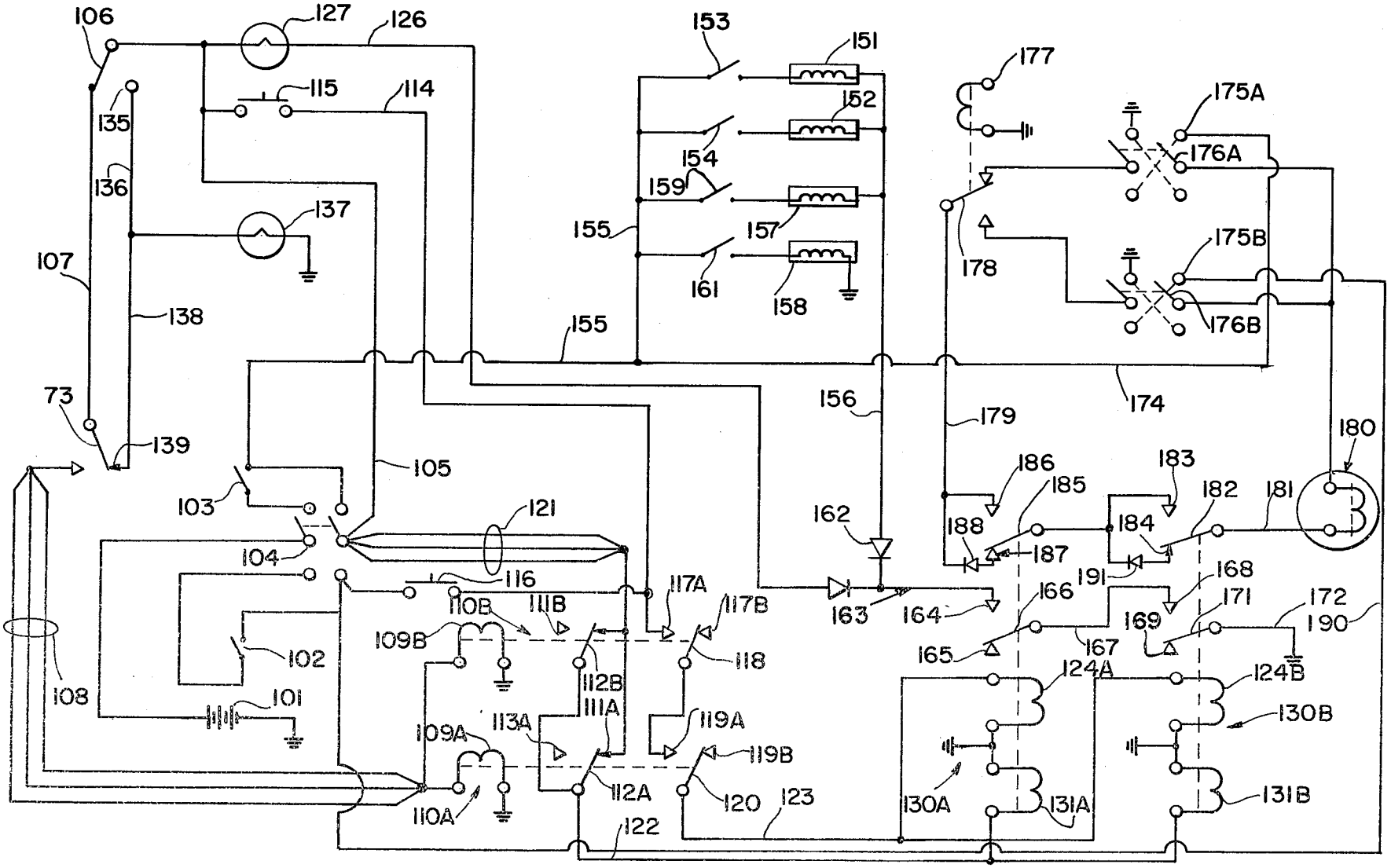
FIG. 5 is a schematic diagram of a protective circuit in accordance with the present invention, in overload condition.

Referring now to FIG. 5, there is shown a protective circuit in accordance with the present invention. This circuit is shown in overload condition, which is following the actuation of the aforementioned overload sensor switch 73. A battery 101 is connected through parallel ignition switches 102 and 103 to a selector switch 104. The switch 102 is an ignition switch, provided on the machine at ground level, whereas switch 103 is an ignition switch on the platform 60. The selector switch 104 thereby may be used to provide for ignition and operation from either the ground or platform 60. A conductor 105 connects selector switch 104 and battery 101 with on-test switch 106, which is shown in the "on" position, thereby connecting the conductor 105 to conductor 107 which leads to the overload sensor switch 73. In the non-overload, non-actuated position of sensor switch 73, it connects the conductor 107 with the conductors 108, and thence to coils 109A and 109B of parallel drop out relays 110A and 110B. The pair of relays 110A and 110B are provided for safety purposes, to overcome a failure situation should one of the relays fail to operate properly. The drop out relays 110A and 110B are spring urged to the position shown, energization of the coils 109A and 109B causing the contacts thereof to move from the positions shown to the alternate positions. In the positions shown, current from the selector switch 104 will be conducted by conductors 121, forming part of a power circuit, through the fixed contacts 111A and 111B to power circuit conductor 122. In the non-overload condition, the movable contacts 112A A and 112B engage unconnected contacts 113A and 113B.

In addition to the conductors 121 and 122 and the switch elements 112A and 112B, the power circuit includes an actuating coil 131A and an actuating coil 131B of a pair of parallel latching relays 130A and 130B.

To rotate the platform 60, hydraulic fluid is supplied to the hydraulic motor 40, flowing to the motor 40 through the line L-3 causing rotation in one direction and flow to the motor 40 through line L-4 causing rotation in the opposite direction. The direction of flow is controlled by a pair of valves (not shown), which are actuated by solenoids 151 and 152, solenoid 151 controlling left rotation of platform 60 and solenoid 152 controlling right rotation thereof. The solenoids 151 and 152 are connected with the battery 101 through a conductor 155 and manually operated switches 153 and 154, located on the platform. These switches and solenoids, with the conductor 156, form a part of the platform rotation control circuit. Telescopic movement of the boom 20 is provided by an "out" telescope control solenoid 157 and an "in" telescope control solenoid 158. A manually operated switch 159 connects solenoid 157 with conductor 155 and a manually operated control switch 161 connects solenoid 158 with conductor 155. The solenoid 157, for "out" or extension of boom 20 is connected to the conductor 156, whereas the "in" telescope solenoid 158 is connected with ground.

The conductor 156 is connected through a diode 162 to a conductor 163 that is connected with one contact 164 of the relay 130A, the corresponding contact 165 of which is unconnected. A moving contact 166 is provided, connected by conductor 167 to a contact 168 of the latching relay 130B, the opposite contact 169 of which is unconnected. A movable contact element 171 is provided, which is connected to ground through a conductor 172. In their non-overload positions, the movable contacts 166 and 171 engage the fixed contacts 164 and 168, respectively, and there is thereby provided one portion of a boom load increasing circuit extending from battery 101 through ignition switch 103, conductor 155 and thence through manually operated switches 153, 154 and 159 and solenoids 151, 152 and 157, conductor 156, diode 162, conductor 163, contacts 164, 166, 168 and 171, and conductor 172 to ground. Since inward telescoping of the boom 20 serves to decrease the load on the boom, the "in" telescope solenoid 158 is directly connected to ground, without passing through the switches of the relays 130A and 130B.

Loading of the boom 20 is also increased when the boom is rotated about a horizontal axis toward the horizontal: up rotation to horizontal, while increasing the load, is not dangerous and is excluded from consideration and definition herein as a load increasing movement. To effect this boom movement, a current reversing switch 175A is provided on the platform, with a handle 176A. A similar current reversing switch 175B with a handle 176B is at ground level. These switches 175A and 175B are connected by the conductors 174, 155, 190 to the battery 101. A selector relay 177 controls a selector switch 178, which connects either the platform-located switch 175A or the ground level switch 175B to a conductor 179. An electric torque motor 180 is directionally rotatable in response to the direction of the current applied to it, and controls the movement of a valve (not shown) which controls the direction of flow of hydraulic fluid to the lift cylinder 19. Consequently, lift cylinder 19 will raise or lower the boom 20 in response to the direction of rotation of electric torque motor 180, which direction is determined by the direction of current flow to it. The electric torque motor 180 is connected by a conductor 181 to a movable switch element 182 that is normally connected to a contact 183 forming a part of the latching relay 130B. A second contact 184 is provided, connected through diode 191 to the movable switch element 185 forming a part of the relay 130A. Contact 183 is also connected to the movable switch element 185. A fixed contact 186 may be engaged by the movable contact 185, which latter is connected directly to the conductor 179. In addition, a corresponding contact 187 is provided, engageable by movable contact 185, and which is connected through a diode 188 to the conductor 179, and hence to the manual control current reversing switches 175A and 175B. As will be understood, in the non-overload condition, the current direction selection switch 175A will be connected through conductor 179 to the electric torque motor 180 through the contacts 186, 185, 183 and 182, and depending upon the position of the switch 175A, current in either direction may be supplied to the electric torque motor 180, to cause the boom 20 to be raised or lowered. In the overload condition, however, when the latching relay coils 131A and 131B have been energized by the flow of current through the power circuit, the switch elements 182 and 185 will be moved to engage the contacts 184 and 187, so that the circuit to the electric torque motor 180 is through the diodes 188 and 191, which limits the flow of current to one direction: specifically, current flow will be limited to the one direction which will permit raising of the boom 20, so as to decrease the load thereon, and the deflection thereof. The switch 175A, conductor 179, switch elements 185 and 182 and electric torque motor 180 thereby form a part of the boom control circuit, permitting movement in the load-decreasing direction of the boom, but not opposite movement, when the switch 73 has sensed an overload.

Connected to the conductor 105 is a reset circuit, including a conductor 114 having therein a reset switch 115, which is located on the platform 60. A corresponding reset switch 116 is provided, at ground level. The conductor 114 is connected with a contact 117A, opposite which is an unconnected contact 117B, these contacts forming a part of the drop out relay 110B. A movable contact 118 is provided, which may engage either of the contacts 117A or 117B, and is connected with a fixed contact 119A of the drop out relay 110A, there being an unconnected contact 119B, and a movable contact 120. Contact 120 is connected with conductor 123, which forms a part of a restoring circuit, with the conductor 114 and reset switch 115, conductor 123 being connected with reset actuating coil 124A of latching relay 130A and reset actuating coil 124B of the latching relay 130B. The coils 124A and 124B will cause the switch elements 166 and 185, and 171 and 182, respectively, to move from the positions shown to the opposite positions thereof, when energized.

Also connected to the conductor 105 is a conductor 126 which includes an indicating light 127, in order to show that the overload system is "on", and an overload tester circuit is provided which includes a contact 135 of switch 106, a conductor 136, and an indicator light 137. Light 137 is also connected by a conductor 138 to a contact 139 of the overload sensor switch 73.

In operation of the apparatus from the workman's platform, the selector switch 104 is moved to the proper position, and ignition switch 103 is actuated. Switch 106 is in the position shown and overload switch 73 is in the opposite position to that shown, thereby connecting battery 101 through switches 103, 104 and 106 to the conductors 108, and energizing the relays 110A and 110B, so that the movable contacts thereof are in the positions opposite to that shown. No current will thereby flow through the power circuit including conductor 122, nor will current flow through the restoring circuit including conductor 123. Movable contacts 182 and 185 will be in engagement with the fixed contacts 183 and 186, thereby providing a control circuit which will permit the boom 20 to lift either up or down, because electric torque motor 180 may be supplied with current flowing in either direction, depending upon the actuation of current reversing switch 175A. Also, the movable contacts 166 and 171 will be in engagement with the fixed contacts 164 and 168, respectively, thereby completing the control circuit which includes the left and right rotation solenoids 151 and 152 and their corresponding switches 153 and 154, there also being completed a circuit through the "out" control solenoid 157 and switch 159. The indicator light 127 will be "on" indicating the appropriate functioning of the protective circuit.

When an overload occurs, from any one or a combination of the causes hereinabove set forth, the overload sensor switch 73 will be actuated, and will be caused to move so as to engage the contact 139, thereby energizing indicator light 137, and also breaking the circuit to the coils 109A and 109B and resulting in the shifting of the movable contacts 112A and 112B, and 120 and 118, to the positions shown. Movable contacts 112A and 112B will complete the power circuit, which includes battery 101, switch 104 and conductors 121 and 122, to the latching relay actuating coils 131A and 131B. This will result in the movement of the movable contacts 166, 185, 171 and 182 to the positions shown, and these movable contacts will be held in the positions shown even should there be a return movement of overload sensor switch 73 so as to again connect the conductors 107 and 108. The return of the overload sensor switch 73 to the position connecting conductors 107 and 108 would again energize the coils 109A and 109B, resulting in the breaking of the power circuit including the conductor 122, but this would have no effect on the positions of the movable contacts of the latching relays 130A and 130B, since they will be latched or retained in the position shown.

The above described movement of overload sensor switch 73 has been found to occur when the boom is moved in a direction towards overload, and passes into a transitional zone: in that situation, due to the flexibility of the boom 20, there is some "bounce" or oscillatory movement of it, which effects movement of overload sensor switch 73 between its two positions. Once the coils 131A and 131B have been energized, and the movable contact elements of the latching relays 130A and 130B have been moved to the positions shown, that part of the control circuit including the electric torque motor 180 can be actuated to lift the boom upwardly, to decrease the deflection-causing load, because current can flow in only one direction through the electric torque motor 180 and diodes 188 and 191. Also, because of the movement of contact elements 166 and 171 to the positions shown in the drawing, the circuit through the rotation controlling solenoids 151 and 152 will be broken, as well as the circuit through the telescope-out solenoid 157, thereby resulting in the interruption of these boom load increasing circuits. The telescope-in solenoid 158, is in a load decreasing circuit that remains unbroken. Consequently, the operator may retract, that is telescope in the boom, by actuation of switch 161, or may raise the boom by appropriate actuation of current directing switch 175A, or both, thereby effecting a decrease in the deflection-causing load on the boom 20, thereby resulting in the overload sensor beam 66 being disengaged from the plunger 72 of overload sensor micro-switch 73, and permitting it to return to the position in which it connects the conductor 107 with the conductor 108, and hence connects the battery 101 with the drop out relays 110A and 110B. This interrupts the power circuit, including the coils 131A and 131B, and shifts the movable contacts 118 and 120 so as to complete the restoring circuit, except for the interruption provided by the reset switch 115. The operator may now close reset switch 115, thereby completing the restoring circuit from battery 101, through conductor 105, reset switch 115, conductor 114, movable contact elements 118 and 120, conductor 123 and the reset coils 124A and 124B: this will now return the movable contacts 166, 185 and 171, 182 to the normal operating positions thereof, in which the control circuits are all fully operable, as hereinabove described.

There has been provided a protective circuit for an overload sensor, disclosed particularly in connection with an aerial platform apparatus, although it will be understood that the herein disclosed system may be used, with obvious modifications, in connection with cranes, as well as in connection with aerial platform apparatus in which the platform is not rotatable. The herein disclosed system provides for the interruption of control circuits which would permit the boom to be moved towards load-increasing positions, and which provides for maintaining such control circuits in interrupted condition independently of any restoration of the overload sensor switch thereof to the non-overload state. Further, the present protective circuitry prevents the oscillation of a boom and opening and closing of the overload sensor switch, which would tend to cause the boom to vibrate or oscillate in a self-energizing system, and tend to be self-destructive.

It will be obvious to those skilled in the art that various changes may be made without departing from the spirit of the invention and therefore the invention is not limited to what is shown in the drawings and described in the specification but only as indicated in the appended claims.

I claim:

1. In combination:

a load supporting boom, means including control circuit means comprising boom load increasing circuit means and boom load decreasing means for increasing and decreasing the loading of said boom, a boom deflection detector comprising overload switch means and means for actuating said overload switch means upon excess deflection of said boom, further circuit means connected to said overload switch means for interrupting said boom load increasing circuit means upon actuation of said overload switch means, said further circuit means comprising means for maintaining said boom load increasing circuit means in interrupted condition independently of said state of said overload switch means, and additional circuit means including re-set means for restoring said interrupted boom load increasing circuit means only upon movement of said overload switch means from the state thereof corresponding to the excess boom deflection state thereof and actuation of said re-set means.

2. The combination of claim 1, said boom load increasing circuit means comprising circuit interrupting means, said maintaining means comprising a power circuit including means for actuating said circuit interrupting means and power circuit switch means in series therewith, and means in series with said overload switch means for actuating said power circuit switch means.

3. The combination of claim 2, wherein said last mentioned means comprises coil means for holding said power circuit switch means open.

4. The combination of claim 2, said restoring circuit means comprising means for actuating said circuit interrupting means oppositely to the actuation thereof by said actuating means of said power circuit, restoring circuit switch means in series therewith, said actuating means in series with said overload switch means also being means for actuating said restoring circuit switch means, and re-set means in said restoring circuit means.

5. The combination of claim 4, wherein said re-set means is a manually operated normally open switch.

6. The combination of claim 1, wherein said boom is a telescopic boom and wherein said control circuit means comprises first means for effecting telescopic elongation of said boom and second means for effecting telescopic retraction of said boom, said control circuit means comprising circuit interrupting means in series only with said means for effecting elongation of said boom.

7. The combination of claim 6, wherein said boom comprises a horizontally rotatable platform, and wherein said control circuit means comprises means for effecting rotation of said platform in series with said control circuit interrupting means.

8. The combination of claim 1, wherein said boom comprises a rotatable platform, wherein said control circuit means comprises means for causing rotation of said platform, said control circuit means comprising means for effecting rotation of said platform in series with said circuit interrupting means.

9. The combination of claim 1, wherein said means for increasing and decreasing the loading of said boom comprises electric torque motor means rotatable in response to applied-circuit direction, wherein said control circuit means comprises current reversing control switch means, and switch means in said control circuit in one position directly connecting said current reversing control switch means to said electric torque motor means and in another position thereof connecting said current reversing control switch means to said electric torque motor means, and unidirectional current means in said control circuit means in series with said control switch means in said other position thereof for permitting current flow to said electric torque means only in the direction to effect a decrease in loading of said boom.

10. The combination of claim 9, wherein said boom is mounted for rotation about a horizontal axis, and including means for raising or lowering said boom about said axis including said electric torque motor means, said means for raising and lowering comprising means for raising said boom when said electric torque motor means is supplied with current through said unidirectional current means.

11. A boom for supporting a load, boom overload sensor means comprising means variable upon overload of said boom, means for increasing and decreasing the load on said boom, means connected with said variable means having a first condition permitting an increase of boom load and a second condition preventing an increase in boom load and being responsive to boom overload variation to change from said first to said second condition, means for maintaining said last mentioned means in said second condition upon movement thereto, and means including selectively actuable means for restoring said two condition means to said first condition only upon reverse variation of said variable means and actuation of said selectively actuable means.

12. The apparatus of claim 11, said selectively actuable means being manually actuated means.

13. The apparatus of claim 11, said variable means being a switch.

14. The apparatus of claim 11, said load increasing and decreasing means comprising means for raising, lowering or telescoping said boom and the control circuit means therefor, and said two condition means comprising switch means on said control circuit means.

15. The apparatus of claim 14, said apparatus comprising a latching relay coil for maintaining said last mentioned switch means in said second condition.

* * * * *